US006157285A

United States Patent [19]

Tokuda et al.

[11] Patent Number: 6,157,285

[45] **Date of Patent: *Dec. 5, 2000**

[54] LAMINATED INDUCTOR

[75] Inventors: Hiromichi Tokuda; Tsuyoshi Tatsukawa, both of Takefu, Japan

[73] Assignee: Murata Manufacturing Co, Ltd, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/080,591

[22] Filed: May 18, 1998

[30] Foreign Application Priority Data

Jun. 4, 1997 [JP] Japan ..... 9-146093

[51] Int. Cl.[7] ..... H01F 5/00

[52] U.S. Cl. ..... 336/200; 336/232; 336/225

[58] Field of Search ..... 336/200, 232, 336/225

[56] References Cited

U.S. PATENT DOCUMENTS

| | | | |
|---|---|---|---|
| 4,803,453 | 2/1989 | Tomono et al. | 336/232 |
| 5,250,923 | 10/1993 | Ushiro et al. | 336/200 |

FOREIGN PATENT DOCUMENTS

| | | | |
|---|---|---|---|
| 2379229 | 9/1978 | France | 336/200 |
| 55-36954 | 3/1980 | Japan | 336/200 |
| 63-24407 | 1/1989 | Japan | 336/200 |
| 6-69038 | 3/1994 | Japan | 336/200 |

*Primary Examiner*—Michael L. Gallner
*Assistant Examiner*—Anh Mai
*Attorney, Agent, or Firm*—Keating & Bennett, LLP

[57] ABSTRACT

A laminated inductor has an increased mechanical strength and includes insulating sheets each having coil conductors and relay via holes, and protective sheets each having lead via holes. The coil conductors are electrically connected in series via the relay via holes to define a coil having a substantially rhomboid shape. Each of the coil conductors is a pattern having a ½ turn which is substantially V-shaped. Each coil conductor is arranged at oblique angles relative to the edges of the respective insulating sheet, and the peripheral surfaces of the coil are inclined relative to the peripheral surfaces of the inductor.

26 Claims, 5 Drawing Sheets

LAMINATED INDUCTOR

BACKGROUND OF THE INVENTION

1. Field of the Invention

The present invention relates to a laminated inductor and, more particularly, to a laminated inductor which is constructed to be incorporated in a high-frequency electronic apparatus.

2. Description of the Related Art

A conventional laminated inductor is shown in FIGS. 6A and 6B. As seen in FIG. 6A, a laminated inductor 81 includes a plurality of insulating sheets 83 having coil inductors 82 disposed on the insulating sheets 83. The insulating sheets 83 are laminated and fired with protective sheets 84 and 85 placed on the opposite sides of the laminated insulating sheets 83. The coil conductors 82 are connected to each other via relay via holes 86 formed in the insulating sheets 83, thereby forming a helical coil 90. The two ends of the helical coil 90 are respectively connected to external input and output electrodes 91 and 92 provided on the opposite ends of the laminated inductor 81 on the left and right sides as viewed in FIG. 6B. This connection is made via lead-out via holes 87 respectively formed in the protective sheets 84 and 85. The input and output external electrodes 91 and 92 are arranged to extend perpendicular to the axial direction of the coil 90 and the direction of stacking of the sheets 83 to 85 to improve an insertion loss characteristic in a high-frequency band by reducing a stray capacitance.

In the conventional laminated inductor 81 shown in FIGS. 6A and 6B, however, the area of contact between each coil conductor 82 and the corresponding insulating sheet 83 in an outer portion of the laminated inductor 81 along the periphery of the inductor body is large since the coil conductor 82 extends parallel to the edges of the insulating sheet 83. Ordinarily, the strength of adhesion between coil conductors 82 and insulating sheets 83 is small. Therefore, the mechanical strength of the inductor 81 is considerably small in an outer portion of the inductor 81 where the area of contact between the coil conductors 82 and the sheets 83 is substantially large. As a result, the inductor 81 can break or split easily at locations between the coil conductors 82 and the insulating sheets 83 in the outer portion when an external force F is applied to the inductor 81 in a direction perpendicular to the direction of stacking of the sheets 83 to 85.

Further, the proportion of a size of each coil conductor 82 relative to the size of a respective insulating sheet 83 upon which it is disposed at an outer portion of the inductor 81 is large and can increase significantly if the gap between the coil conductor 82 and one edge of the insulating sheet 83 is reduced due to, for example, a cutting position error occurring at the time of cutting out the inductor block from a mother laminated member, a printing error occurring at the time of forming the coil conductor 82 on the insulating sheet 83, or an error in the superposed position of the insulating sheet 83, resulting in a considerable reduction in the mechanical strength of the inductor 81.

To solve these problems, the gaps between each coil conductor 82 and the edges of the insulating sheet 83 may be increased by reducing the diameter of the helical coil. In such a case, however, inductance L becomes smaller. If the number of turns of the helical coil is increased to compensate for the reduction in inductance L, the number of insulating sheets 83 becomes larger resulting in an increase in manufacturing cost. Alternatively, the width of the pattern of the coil conductor 82 may be reduced to reduce the area of contact between the coil conductor 82 and the insulating sheet 83 in an outer portion of the inductor 81 along the periphery of the inductor body. Then, the DC resistance of the coil conductor 82 is increased, resulting in a deterioration of the efficiency of the inductor 81.

SUMMARY OF THE INVENTION

To overcome the problems described above, preferred embodiments of the present invention provide a laminated inductor having a high mechanical strength without experiencing an increase in manufacturing cost or a deterioration in inductor efficiency.

According to a preferred embodiment of the present invention, there is provided a laminated inductor including a laminated body having a plurality of coil conductors and insulating layers superposed on one another, the laminated body including a helical coil defined by connecting the coil conductors in series via openings formed in the insulating layers, a pair of external input and output electrodes connected to the coil and disposed on a pair of opposite surfaces of the laminated body, the external input and output electrodes being arranged substantially perpendicular relative to the direction of superposing of the layers of the laminated body and relative to the axial direction of the coil, wherein the coil conductors are arranged to either be substantially inclined relative to edges of the insulating layers or to have a substantially curved shape.

With the structure of the preferred embodiments of the present invention, the area of contact between the coil conductors and the insulating layers at an outer portion of the inductor along the periphery of the laminated body is reduced because the coil conductors are arranged to be substantially inclined relative to the edges of the insulating layers or to have a substantially curved shape. Therefore, even if an external force is applied to the inductor in a direction perpendicular to the direction of superposition of the insulating layers, the inductor does not break or split easily in the outer portion.

DETAILED DESCRIPTION OF PREFERRED EMBODIMENTS

Figure 2A:
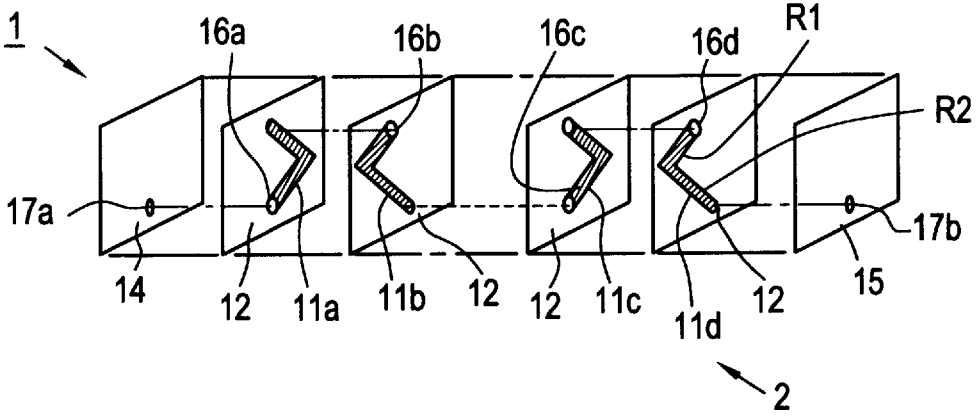
FIG. 2A is an exploded perspective view of the laminated inductor shown in FIG. 1.

Laminated inductors according to preferred embodiments of the present invention will be described below with reference to the accompanying drawings. The same or identical portions or components of preferred embodiments are indicated by the same reference characters.

Figure 1:
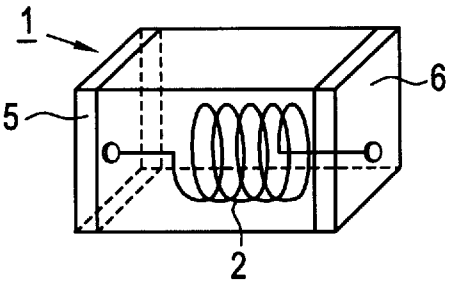
FIG. 1 is a schematic perspective view of the internal structure of a laminated inductor according to a preferred embodiment of the present invention.

As schematically shown in FIG. 1, a laminated inductor 1 has an external input electrode 5 and an external output electrode 6 respectively provided on opposite end surfaces on the left and right sides as viewed in FIG. 1. The axial direction of a helical coil 2 included in the inductor 1 is preferably substantially perpendicular to the external electrodes 5 and 6. One end of the coil 2 is electrically connected to the external input electrode 5 while the other end of the coil 2 is electrically connected to the external output electrode 6.

The structure of the inductor 1 will be described with reference to FIGS. 2A and 2B.

As shown in FIG. 2A, the inductor 1 preferably includes insulating sheets 12 respectively having coil conductors 11*a*, 11*b*, 11*c*, and 11*d* and relay via holes (openings) 16*a*, 16*b*, 16*c*, and 16*d*, and protective sheets 14 and 15 respectively having lead-out via holes (openings) 17*a* and 17*b*. The coil conductors 11*a* to 11*d* are electrically connected in series via the relay via holes 16*b* to 16*d* to form a coil 2. Each of the coil conductors 11*a* to 11*d* is preferably arranged as a pattern of a ½ turn having two arm portions R1 and R2 and having a substantially V-shaped configuration. Each of the coil conductors 11*a* to 11*d* is arranged on the insulating sheet 12 so as to extend obliquely toward the edges of the insulating sheet 12. That is, the longitudinal direction of each of the arm portions R1 and R2 of the coil conductors 11*a* to 11*d* is preferably arranged at oblique angles relative to the edges of the insulating sheets 12.

The coil conductors 11*a* to 11*d* are preferably made of Ag, Pd, Ag—Pd, Cu or the like and are preferably formed by well-known techniques such as printing, sputtering, vacuum deposition or other suitable methods. Each of the substantially rectangular insulating sheets 12, 14, and 15 is preferably formed in such a manner that a material prepared by kneading a nonmagnetic ceramic powder and a magnetic powder such as a ferrite powder with a binder is formed into a sheet.

The sheets 12, 14, and 15 are superposed on one another and integrally formed by being fired to form a laminated body having a structure such as that shown in FIG. 1. Next, the external input electrode 5 and the external output electrode 6 are respectively disposed on the left and right side surfaces of the laminated body. The external electrodes 5 and 6 are preferably formed by sputtering, vacuum deposition, coating and baking, or other suitable method.

The external input electrode 5 is electrically connected to one end of the coil 2, i.e., the end of the coil conductor 11*a*, via the lead-out via hole 17*a* and the relay via hole 16*a*. The output external electrode 6 is electrically connected to the other end of the coil 2, i.e., the end of the coil conductor 11*d*, via the lead-out via hole 17*b*.

In the laminated inductor 1 described above with reference to FIGS. 2A and 2B, the direction of superposition of the sheets 12, 14 and 15 is preferably substantially perpendicular to the external input and output electrodes 5 and 6, and the axial direction of the coil 2 is also preferably substantially perpendicular to the external input and output electrodes 5 and 6. The stray capacitance existing between the coil 2 and the external electrodes 5 and 6 is extremely small because the potential differences between the coil 2 and the external input and output electrodes 5 and 6 are small.

Figure 2B:
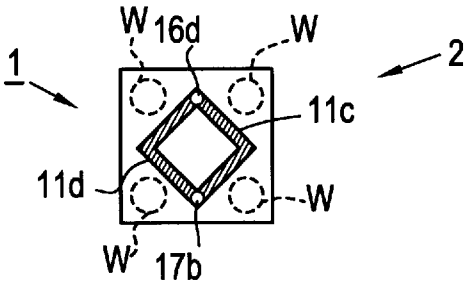
FIG. 2B is a schematic side view of an internal portion of the laminated inductor shown in FIG. 1 viewed from the right-hand side.

As shown in FIG. 2B, the coil 2 preferably has a substantially rhombic cross section, and the peripheral surfaces of the coil 2 are preferably arranged at oblique angles relative to the peripheral surfaces of the inductor 1. Also, the structure of this inductor is such that the coil conductors 11*a* to 11*d* are arranged such that four corner portions W are defined. The corner portions W have no coil conductors located thereat. At these corner portions W, a comparatively strong external force can be applied and separation between the layers 12 can occur easily in prior art devices. However, in preferred embodiments of the present invention, the area of contact between the coil conductors 11*a* to 11*d* and the insulating sheets 12 in an outer portion of the inductor 1 is reduced so that, even if an external force is applied to the inductor 1 in a direction perpendicular to the direction of superposition of the sheets 12, 14, and 15, separation between the coil conductors 11*a* to 11*d* and the insulating sheets 12 in the outer portion of the inductor 1 cannot occur easily. Thus, the laminated inductor 1 has an increased mechanical strength.

Further, the proportion of the coil conductors 11*a* to 11*d* in the outer portion of the inductor 1 is restricted and is stably maintained. Variation in the proportion of the coil conductors 11*a* to 11*d* is negligibly small even if the gap between each of the coil conductors 11*a* to 11*d* and the corresponding sheet 12 is reduced due to, for example, a cutting position, a printing error or an error in the superposed position of the insulating sheet 12. Thus, the desired mechanical strength of the inductor 1 can be reliably maintained.

Figure 3A:
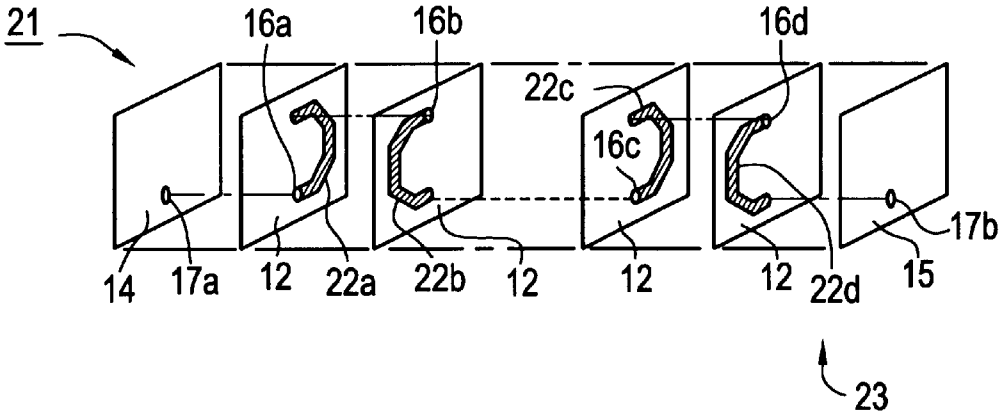
FIG. 3A is an exploded perspective view of a laminated inductor according to a second preferred embodiment of the present invention.

As shown in FIG. 3A, a laminated inductor 21 in accordance with a second preferred embodiment of the present invention preferably has the same structure as the above-described first embodiment inductor 1 except for the arrangement of the coil conductors 22*a* to 22*d*.

Figure 3B:
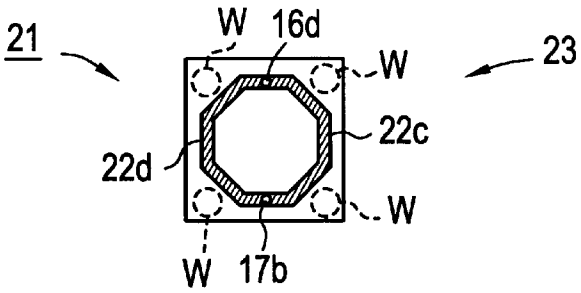
FIG. 3B is a schematic side view of an internal portion of the laminated inductor shown in FIG. 3A viewed from the right-hand side.

The coil conductors 22*a* to 22*d* are electrically connected in series via relay via holes 16*b* to 16*d* to define a helical coil 23. Each of the coil conductors 22*a* to 22*d* preferably has a substantially U-shaped pattern of a ½ turn such that the cross-sectional configuration of the coil 23 has a substantially circular shape to improve the Q characteristic of the inductor 21. Each of the coil conductors 22*a* to 22*d* curves or bends toward the edges of the insulating sheet 12. As shown in FIG. 3B, the coil 23 preferably has a substantially octagonal cross section. The coil conductors 22*a* to 22*d* are preferably arranged so as to define four corner portions W wherein no coil conductors are located at such corner portions W.

The inductor 21 arranged as described above operates in the same manner and achieves the same advantages as the above-described first preferred embodiment of the inductor 1.

Figure 4A:
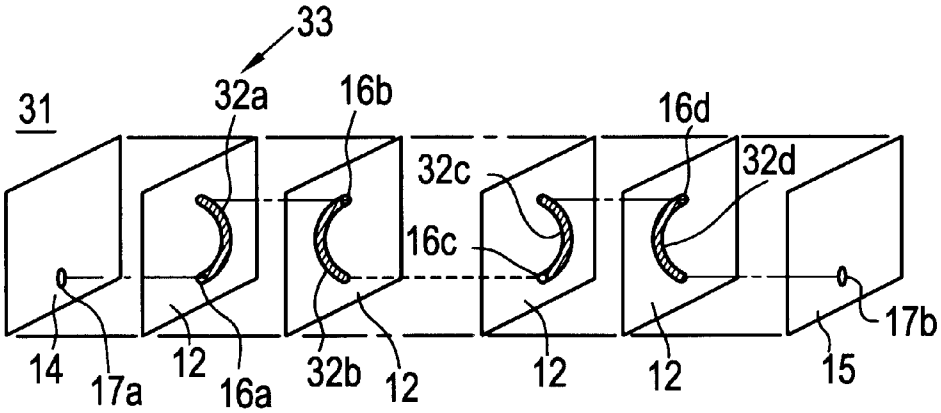
FIG. 4A is an exploded perspective view of a laminated inductor according to a third preferred embodiment of the present invention.

As shown in FIG. 4A, a laminated inductor 31 in accordance with the third preferred embodiment of the present invention preferably has the same structure as the above-described first preferred embodiment inductor 1 with the exception of coil conductors 32*a* to 32*d*. The coil conductors

Figure 4B:
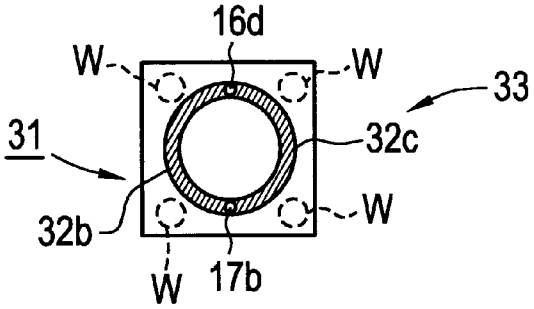
FIG. 4B is a schematic side view of an internal portion of the laminated inductor shown in FIG. 4A viewed from the right-hand side.

32*a* to 32*d* are electrically connected in series via relay via holes 16*b* to 16*d* to define a helical coil 33. Each of the coil conductors 32*a* to 32*d* preferably has a substantially semicircular pattern which curves towards the edges of the insulating sheet 12. Accordingly, the coil 33 has a substantially circular cross section, as shown in FIG. 4B. Thus, the inductor 33 having an improved Q characteristic is obtained.

Figure 5A:
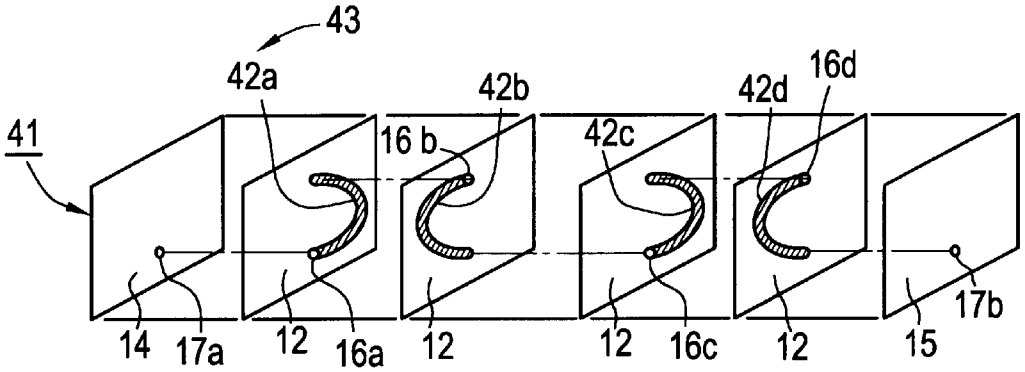
FIG. 5A is an exploded perspective view of a laminated inductor according to a fourth preferred embodiment of the present invention.
Figure 5B:
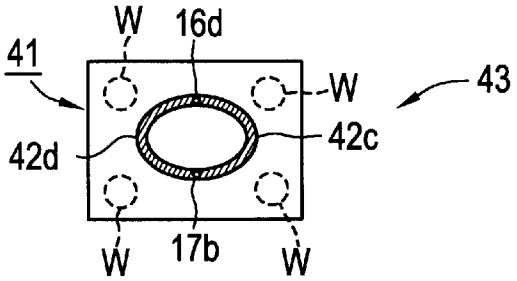
FIG. 5B is a schematic side view of an internal portion of the laminated inductor shown in FIG. 4A viewed from the right-hand side.
Figure 6A:
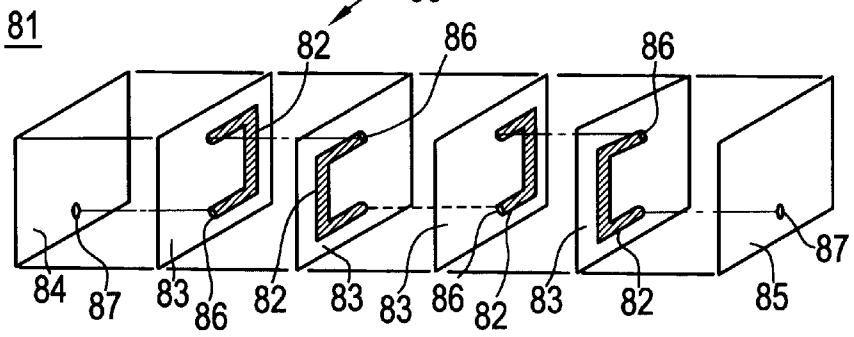
FIG. 6A PRIOR ART
FIG. 6A is an exploded perspective view of a conventional laminated inductor.
Figure 6B:
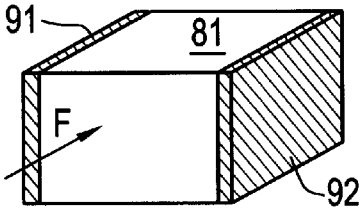
FIG. 6B PRIOR ART
FIG. 6B is a perspective view of an external appearance of the conventional laminated inductor shown in FIG. 6A.

If the insulating sheets 12, 14, and 15 are substantially rectangular as shown in FIG. 5A, a coil 43 having a substantially elliptical cross section to increase inductance L by increasing the diameter may be used instead of the coil having a substantially circular cross section. Each of coil conductors 42*a* to 42*d* of this coil preferably includes a generally U-shaped pattern which curves toward the edges of the insulating sheet 12 (see FIG. 5B). This laminated inductor 41 in accordance with the fourth preferred embodiment of the present invention operates in the same manner and achieves the same advantages as the above-described first preferred embodiment of the inductor 1.

The laminated inductor of the present invention is not limited to the above-described preferred embodiments and may be variously changed within the scope of the present invention.

In the above-described preferred embodiments, insulating sheets on which coil conductors are disposed are superposed on one another and are thereafter formed as an integral block unit by being fired. However, the insulative sheets which have been previously fired may also be used.

Also, a laminated inductor may be made by a manufacturing method described below. A paste-like insulating material is formed into an insulating layer by printing or the like. A paste-like electroconductive material is applied to a surface of the insulating layer so as to form a coil conductor having a desired shape. Next, the paste-like insulating material is applied over the coil conductor to form another insulating layer. Successively, other layers are superposed by applying the same materials to obtain an inductor having a laminated structure.

According to preferred embodiments of the present invention, as is apparent from the above description, the area of contact between each coil conductor and the corresponding insulating layer at an outer portion of the inductor is significantly reduced since the coil conductor is arranged to be substantially inclined relative to the edges of the insulating layer or to have a substantially curved shape. According to preferred embodiments of the present invention, while each coil conductor can be arranged in either of the generally oblique configuration and the generally curved configuration, the arrangement of the coil in the oblique configuration is more effective.

Even if a cutting position error or the like occurs when the inductor is cut out of a mother laminated member, the desired mechanical strength of the inductor can be stably maintained since the proportion of the coil conductors in an outer portion of the inductor is small. Consequently, a laminated inductor having a high mechanical strength can be obtained without an increase in manufacturing cost and without a deterioration in efficiency.

While the invention has been described and particularly shown with reference to preferred embodiments thereof, it will be understood to those skilled in the art that the foregoing and other changes in form and details may be made therein without departing from the spirit and scope of the invention.

What is claimed is:

1. A laminated inductor comprising:

a laminated body including a plurality of coil conductors and insulating layers superposed on one another in a laminating direction which extends along a lateral axis of said laminated body which is perpendicular to a vertical dimension of said laminated body, said laminated body including a helical coil defined by said coil conductors being connected in series, the helical coil extending in a winding direction along the lateral axis of said laminated body; and an external input electrode and an external output electrode connected to said coil and disposed on a pair of opposite surfaces of said laminated body, said external input and output electrodes being arranged to be substantially perpendicular to the laminating direction of said laminated body and to said winding direction of said coil; wherein each of the coil conductors is inclined relative to each of two connected sides at each of the corners of the insulating layer upon which the respective coil conductor is disposed and two of the coil conductors which are connected to a respective one of the external input electrode and the external output electrode are, at all portions thereof, inclined relative to and spaced from the sides of the respective insulating layer upon which said respective one of the two coil conductors are disposed.

2. A laminated inductor according to claim 1, wherein each of said coil conductors has a substantially V-shaped configuration.

3. A laminated inductor according to claim 1, wherein each of said coil conductors has two arm portions defining a half turn of said coil.

4. A laminated inductor according to claim 1, wherein said coil conductors are made of a material selected from the group consisting of Ag, Pd, Ag—Pd, and Cu.

5. A laminated inductor according to claim 1, wherein the coil has a substantially rhomboid cross section.

6. A laminated inductor according to claim 1, wherein each of said coil conductors is arranged on a respective one of said insulating sheets such that four corner portions are defined on said respective one of said insulating sheets, wherein the coil conductors are not located in the four corner portions.

7. A laminated inductor according to claim 1, wherein each of said coil conductors has a substantially semicircular shape.

8. A laminated inductor according to claim 7, wherein each of said coil conductors is arranged on a respective one of said insulating sheets such that four corner portions are defined on said respective one of said insulating sheets, wherein the coil conductors are not located in the four corner portions.

9. A laminated inductor according to claim 1, wherein said coil has a substantially circular cross section.

10. A laminated inductor according to claim 1, wherein said helical coil has a substantially elliptical shape.

11. A laminated inductor according to claim 1, wherein each of the insulating layers has a substantially rectangular shape or a substantially square shape.

12. A laminated inductor comprising:

a laminated body including a plurality of coil conductors and insulating layers superposed on one another in a laminating direction which extends along a lateral axis of said laminated body which is perpendicular to a vertical dimension of said laminated body, said laminated body including a helical coil defined by said coil conductors being connected in series, the helical coil extending in a winding direction along the lateral axis of said laminated body; and an external input electrode and an external output electrode connected to said coil and disposed on a pair of opposite end surfaces of said laminated body, said external input and output electrodes being arranged to be substantially perpendicular to the laminating direction of said laminated body and to winding direction of said coil; wherein said coil conductors are arranged to have a substantially curved shape configuration, each of the coil conductors is inclined relative to each of two connected sides at each of the corners of the insulating layer upon which the respective coil conductor is disposed and two of the coil conductors which are connected to a respective one of the external input electrode and the external output electrode are, at all portions thereof, inclined relative to and spaced from the sides of the respective insulating layer upon which said a respective one of the two coil conductors are disposed.

13. A laminated inductor according to claim 12, wherein the coil has a substantially circular cross section.

14. A laminated inductor according to claim 12, wherein each of said coil conductors is arranged on a respective one of said insulating sheets such that four corner portions are defined on said respective one of said insulating sheets, wherein the coil conductors are not located in the four corner portions.

15. A laminated inductor according to claim 12, wherein each of said coil conductors has a substantially semicircular shape.

16. A laminated inductor according to claim 15, wherein each of said coil conductors is arranged on a respective one of said insulating sheets such that four corner portions are defined, wherein the coil conductors are not located in the four corner portions.

17. A laminated inductor according to claim 12, wherein said coil conductors are made of a material selected from the group consisting of Ag, Pd, Ag—Pd, and Cu.

18. A laminated inductor according to claim 12, wherein the coil has a substantially octagonal cross section.

19. A laminated inductor according to claim 12, wherein said helical coil has a substantially elliptical shape.

20. A laminated inductor according to claim 12, wherein each of the insulating layers has a substantially rectangular shape or a substantially square shape.

21. An inductor comprising:

a main body including a plurality of coil conductors and insulating layers superposed on one another in a laminating direction which extends along a lateral axis of said laminated body which is perpendicular to a vertical dimension of said laminated body, said main body including a helical coil defined by said coil conductors being connected in series, the helical coil extending in a winding direction along the lateral axis of said main body; and an external input electrode and an external output electrode connected to said coil and disposed on a pair of opposite surfaces of said main body; wherein each of the coil conductors is inclined relative to each of the sides of the insulating layer upon which the respective coil conductor is disposed and two of the coil conductors which are connected to a respective one of the external input electrode and the external output electrode are, at all portions thereof, inclined relative to and spaced from the sides of the respective insulating layer upon which said a respective one of the two coil conductors are disposed.

22. An inductor according to claim 21, wherein each of said coil conductors is arranged on a respective one of said insulating sheets such that four corner portions are defined on said respective one of said insulating sheets, wherein the coil conductors are not located in the four corner portions.

23. An inductor according to claim 21, wherein each of said coil conductors has one of a substantially V-shaped configuration and a substantially semicircular configuration.

24. An inductor according to claim 21, wherein the coil has a substantially rhomboid cross section.

25. An inductor according to claim 21, wherein said helical coil has a substantially elliptical shape.

26. An inductor according to claim 21, wherein each of the insulating layers has a substantially rectangular shape or a substantially square shape.

* * * * *